United States Patent [19]

Oya et al.

[11] 4,148,239

[45] Apr. 10, 1979

[54] ELECTRONIC MUSICAL INSTRUMENT EXHIBITING RANDOMNESS IN TONE ELEMENTS

[75] Inventors: Akiyoshi Oya; Shigeru Yamada, both of Hamamatsu, Japan

[73] Assignee: Nippon Gakki Seizo Kabushiki Kaisha, Hamamatsu, Japan

[21] Appl. No.: 928,837

[22] Filed: Jul. 28, 1978

[30] Foreign Application Priority Data

Jul. 30, 1977 [JP] Japan ..... 52-91598

[51] Int. Cl.[2] ..... G10F 1/02

[52] U.S. Cl. ..... 84/1.03; 84/1.24

[58] Field of Search ..... 84/1.01, 1.03, 1.24, 84/1.25, 1.27, 1.28, DIG. 12

[56] References Cited

U.S. PATENT DOCUMENTS

| | | | |
|---|---|---|---|
| 3,629,480 | 12/1971 | Harris | 84/1.03 |
| 3,629,482 | 12/1971 | Pulfer et al. | 84/1.03 |
| 3,696,201 | 10/1972 | Arsem et al. | 84/1.01 |
| 3,781,452 | 12/1973 | Vauclain | 84/1.28 |
| 3,952,624 | 4/1976 | Kawakami | 84/1.27 |
| 3,965,789 | 6/1976 | Pearlman | 84/1.24 |
| 4,026,180 | 5/1977 | Tomisawa | 84/1.01 |
| 4,116,103 | 9/1978 | Deutsch | 84/1.24 |

*Primary Examiner*—Gene Z. Rubinson
*Assistant Examiner*—Forester W. Isen
*Attorney, Agent, or Firm*—Schatzel & Hamrick

[57] ABSTRACT

The electronic musical instrument is provided with a musical tone signal generating unit for generating a musical tone signal having a tone pitch corresponding to a depressed key, a self-running counter for counting a multibit digital quantity, a latch circuit for latching the output of the counter when supplied with a pulse signal representing the depression of a key, and modifying means responsive to the output of the latch circuit for modifying the musical tone elements, that is the pitch, color and volume of the musical tone signal generated by the musical tone signal generating unit.

15 Claims, 10 Drawing Figures

FIRST MUSICAL TONE GENERATOR 23
SECOND MUSICAL TONE GENERATOR 24
KEY SWITCH CIRCUIT
1
KEY ASSIGNER
22
KC
FREQUENCY INFORMATION MEMORY DEVICE
2
F
FIRST MULTIPLIER
3a
3b
Fa
Fb
ACCUMULATOR
4a
4b
Φ
qFa
qFb
WAVEFORM MEMORY
5a
5b
MSa
MSb
SECOND MULTIPLIER
6a
6b
SOUND SYSTEM
7
EC
ENVELOPE WAVEFORM GENERATOR
25
Ax
D-A CONVERTER
31
X1
X2
RANDOM SIGNAL GENERATING UNIT
26
ES
DF
DS
AP

ELECTRONIC MUSICAL INSTRUMENT EXHIBITING RANDOMNESS IN TONE ELEMENTS

This invention relates to an electronic musical instrument which can produce musically rich performance tones by modifying such musical tone elements or properties as the pitch, color and volume of the musical tone generated by a random signal whose content is accidentally different depending on the timing of key operation.

Generally, in an electronic musical instrument, the selection of the pitch of the generated musical tone and the designation of the timing of generating the musical tone are performed in accordance with the operation of the keys of a keyboard and the setting of the pitch standard (e.g. $A_4$ = 440 Hz) of the generated musical tone and the selection of the tone color and volume thereof and of the shape of the envelope are set by various operating members (for example, a pitch setter, tone levers, etc.) mounted on a panel. Since these operating members are mounted on the panel of the musical instrument, the player cannot operate them as desired during performance so that these operating members are generally preset before performance. For this reason, musical tones having the same characters or properties (i.e., the same pitch setting, color, volume and envelope) are produced during the performance, thus resulting in monotonic performance tones of less variety.

SUMMARY OF THE PRESENT INVENTION

Accordingly, it is an object of this invention to provide an electronic musical instrument wherein a randomness is imparted to various musical tone elements (properties) of the musical tone generated thus producing musically rich performance tones.

Another object of this invention is to provide an electronic musical instrument of the digital type which has extremely simple construction and can impart randomness to various musical tone elements (properties) and in which the entire circuit of the musical instrument can be fabricated with integrated circuits.

According to this invention there is provided an electronic musical instrument comprising a plurality of keys; a key switch circuit including a plurality of switches corresponding to respective keys and adapted to generate note designating signals and a timing signal representing the depression of a key; a musical tone signal generating unit responsive to the note designating signal and the timing signal for generating a musical tone signal having a predetermined pitch (i.e., frequency) corresponding to the depressed key with the timing of the timing signal; a self-running counter to produce a multi-bit figure; and a latch circuit supplied with the output of the counter; said latch circuit latching the output of the self-running counter in response to the timing signal; said musical tone signal generating unit including means for determining such musical tone elements as the pitch (frequency), color (wave shape or timbre), and volume (amplitude) of a musical tone signal to be generated thereby; and determining means including means responsive to the output of the latch circuit for modifying at least one of the musical tone elements for imparting a randomness with respect to time to the musical tone elements.

According to another feature of this invention there is provided an electronic musical instrument comprising a plurality of keys; a key switch circuit including a plurality of keys corresponding to respective keys for generating note designating signals and a timing signal representing a depressed key; a musical tone signal generating unit responsive to the note designating signal and the timing signal for generating a musical tone signal having a predetermined tone pitch corresponding to a depressed key with a timing of said timing signal; a plurality of independent self-running counters to output multi-bit figures from each thereof; a plurality of latch circuits independently supplied with the outputs of respective counters; and each one of said latch circuits latching the output of an associated self-running counter; each one of said musical tone signal generating units including means for determining such musical elements as the pitch, color and volume of a musical tone signal to be generated thereby; the determining means including means responsive to the outputs of different latch circuits for modifying at least one of the musical tone elements so as to impart a randomness with respect to time to the musical tone element.

IN THE DRAWING

DETAILED DESCRIPTION OF THE PREFERRED EMBODIMENT

Figure 1:
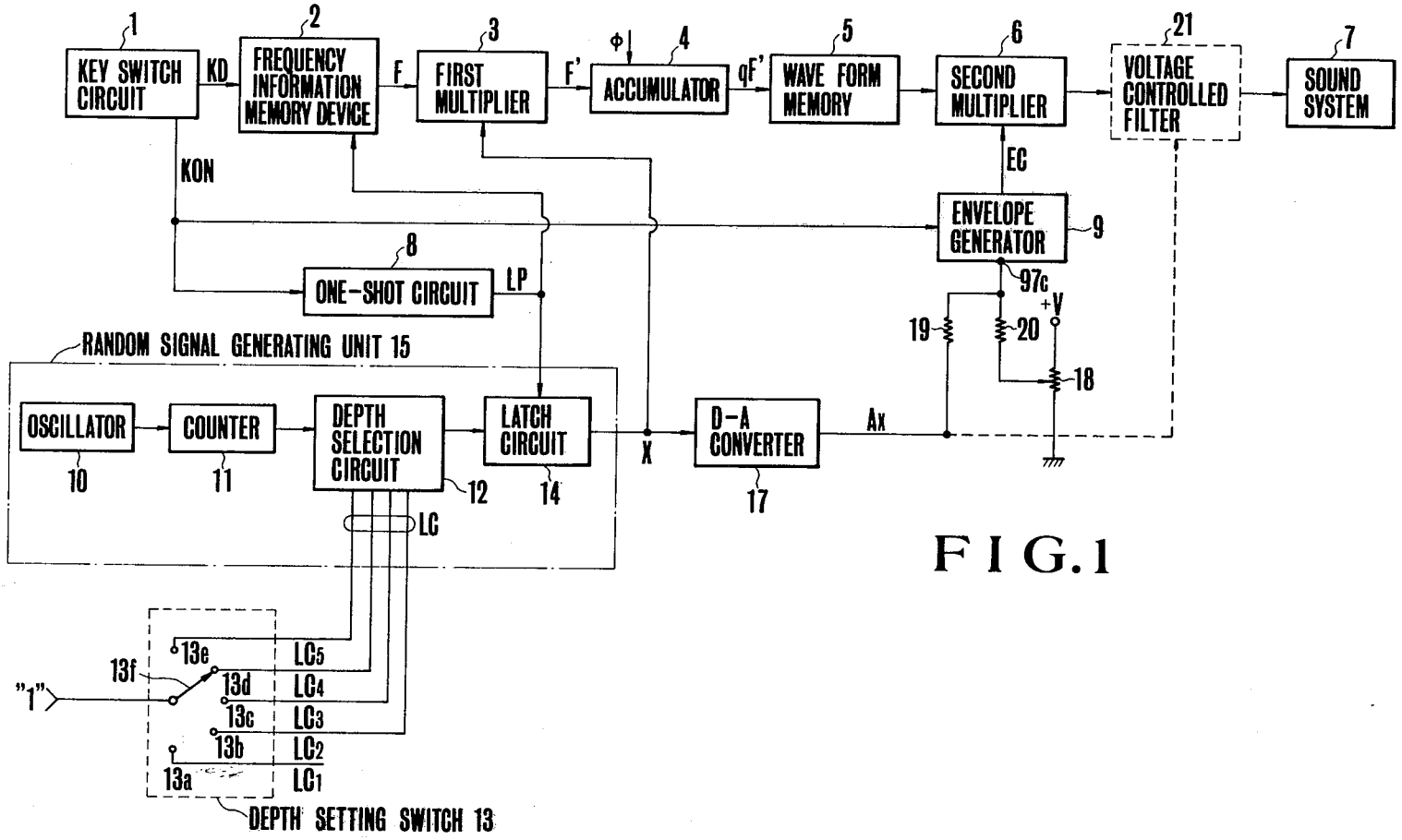
FIG. 1 is a block diagram showing one embodiment of the electronic musical instrument embodying the invention.
Figure 2:
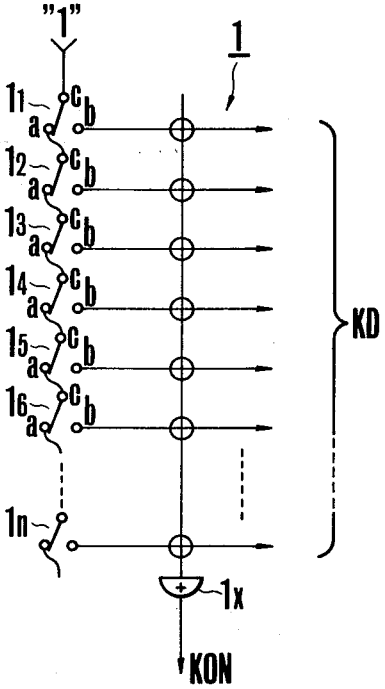
FIG. 2 is a connection diagram showing one example of the key switch circuit shown in FIG. 1.

The preferred embodiment of this invention shown in FIG. 1 comprises a key switch circuit 1 on a keyboard, not shown. As shown in FIG. 2, the key switch circuit 1 comprises a plurality of transfer type key switches corresponding to respective keys $\mathbf{1}_1$-$\mathbf{1}_n$ which are connected in series when the associated keys are released to form a preferential connection. When the keys are depressed the movable contacts c of the key switches $\mathbf{1}_1$-$\mathbf{1}_n$ are brought to engage with normally opened stationary contacts a so as to produce a signal "1" from only the normally opened contact b of the key switch at the most significant order (in this case the source side) among the switches associated with the depressed keys. Hereinafter the signal "1" is termed a key data KD. The key data KD produced by respective key switches $\mathbf{1}_1$-$\mathbf{1}_n$ produce a key-on signal KON through an OR gate circuit $\mathbf{1}_x$ showing that one of the keys is in a depressed state. A frequency information memory device 2 is connected to the output of the key switch circuit 1 to store the frequency information corresponding to the tone pitches (frequencies) of respective keys. The frequency information memory device 2 is addressed by the key data supplied from the key switch circuit 1 to read out corresponding frequency informations F. A first multiplier 3 is provided to multiply a frequency information read out from the frequency information memory device 2 with a random signal X supplied from a random signal generating unit 15 to be described later so as to produce a modulated or modified frequency information F. An acculumator 4 is connected to the output of the first multiplier 3 for sequentially accumulating the modulated frequency information F' produced by the first multiplier 3 at a timing of a clock pulse $\phi$. A waveform memory device 5 stores the amplitude values at successive sampling points in one period of a desired musical tone waveform in respective addresses of the waveform memory device 5. When addressed by an accumulated value qF' (q=1, 2 . . . ) produced by the accumulator 4, the amplitude value stored in the address of the waveform memory device 5 is read out. A second multiplier 6 is provided to multiply a musical tone waveform read out from the waveform memory device 5 with an envelope waveform EC produced by an envelope waveform generator 9 to be described later for applying a volume envelope to the musical tone waveform. A sound system 7 is connected to the output of the second multiplier 6 to produce the musical tone wave imparted with the volume envelope as a performance tone. A one-shot circuit 8 is connected to the output of the key switch circuit 1 for producing a latch pulse LP in response to the build-up of the key-on signal KON generated by the key switch circuit 1. An envelope waveform generating circuit 9 is provided to start its operation when a key-on signal KON is produced to produce an envelope waveform EC, such as attack, decay and sustain of the musical tone waveform. The detail of the construction of the envelope waveform generator 9 is shown in FIG. 3.

Figure 3:
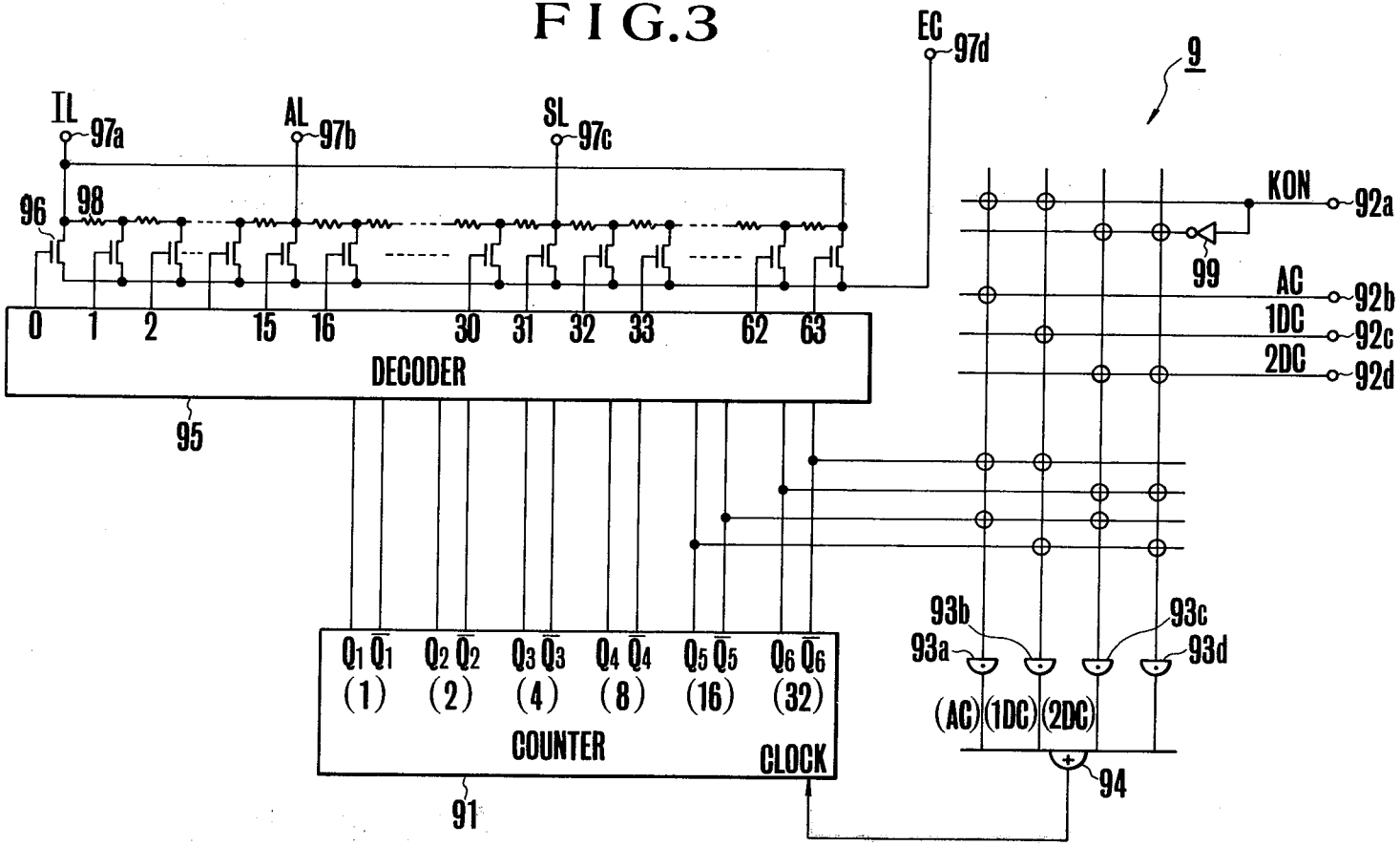
FIG. 3 is a connection diagram showing one example of the envelope waveform generator shown in FIG. 1.

In a waiting state (before key depression) the binary code outputs $Q_1$ through $Q_6$ of a 64 step counter 91 shown in FIG. 3 are all "0" whereas the outputs $\overline{Q_1}$ through $\overline{Q_6}$ are all "1". Under this state when a key-on signal KON is produced to produce an envelope shape, such as attack, decay and sustain of the musi- "1", and AND gate circuit 93*a* produces a pulse output each time an attack clock pulse AC is applied from an oscillator not shown. The output of AND gate circuit 93*a* is supplied to the clock terminal of the counter 91 through an OR gate circuit 94 to act as an attack pulse AC for causing the counter 91 through an OR gate circuit 94 to act as as attack pulse AC for causing the counter 91 to sequentially up-count. The binary code output of this counter 91 is converted into a decimal number by a decoder 95 to produce an output signal on its corresponding output terminal alone. Consequently, each time the count of the counter 91 is increased by the attack clock pulse AC the output terminal of the decoder 95 varies sequentially from terminal 0 toward terminal 63. As the output terminal of the decoder 95 shifts in this manner, a transistor 96 connected to a terminal of the decoder 95 which produces an output is turned ON. At this time, an initial level signal IL is applied to terminal 97 a and an attack level signal AL and a sustain level signal SL are applied to terminals 97*b* and 97*c* respectively. A resistor 98 is connected to divide the voltage impressed across terminals 97*a*, 97*b* and 97*c* and each one of the transistors 96 is connected to select the voltage at a voltage dividing point and supply it to an output terminal 97*d*. As a consequence, as the counter 91 up-counts in response to the attack clock pulse AC, the decoded output terminal of the decoder 95 also shifts to sequentially turn ON transistors 96 whereby the envelope signal EC appearing at the output terminal 97*a* increases from inital level IL toward attack level AC. More particularly, when the count of the counter 91 reaches 15, the output of the decoder 95 appears at its output terminal 15 to reach the attack level AL. When the count of counter 91 reaches 16, its output terminal $Q_5$ becomes "1" whereas output terminal $Q_6$ becomes "0", with the result that AND gate circuit 93*b* is enabled to supply the first decay clock pulse appearing on terminal 92*c* to the clock input of the counter 91 via OR gate circuit 94. Consequently, after the count 16, the counter 91 proceeds its counting operation by utilizing the first decay clock pulse 1DC as the clock pulse and the decoder 91 moves the selecting point of transistors 96 towards the side of sustain level SL. However, since the sustain level SL is set to a voltage value lower than the attack level AL, the envelope signal EC appearing at the output terminal 97*d* decreases gradually. When the count of the counter 91 reaches 32, "1" is produced at output terminal $Q_6$ while "0" at output terminal $\overline{Q_6}$ so that the AND gate circuit 93*b* is disenabled and the counter 91 stops its counting operation caused by the first decay clock pulse 1DC. Then as the depressed key is released and the key-on signal KON becomes "0" the output of an inverter 99 becomes "1". Accordingly, the AND gate circuit 93*c* is enabled to supply the second decay clock pulse 2DC supplied to the terminal 92*d* to the clock input of the counter 91 via OR gate circuit 94. Consequently, the counter 91 is caused to up-count by the second decay clock pulse 2DC, and its output is decoded by the decoder 95 thereby shifting its output from output terminal 32 to output terminal 63. Thus, the envelope signal EC sent out from the output terminal 97*d* gradually decreases from the sustain level SL to the inital level IL. When the count of the counter 91 reaches 63, the output terminals $Q_5$ and $Q_6$ become "1" so that the AND gate circuit 93*d* is enabled to supply the second decay clock pulse 2DC to the clock input of the counter 91 via OR gate circuit 94. When supplied with a single second decay clock pulse 2DC, the counter 91 overflows to return its count to zero whereby AND gate circuits 93*a* through 93*d* are all disenabled thus stopping the generation of the envelope signal EC.

Turning back to FIG. 1 there are also provided an oscillator 10 which generates a reference signal, a 4-bit counter 11 which sequentially counts the number of the oscillation outputs of the oscillator 10, a depth selection circuit 12 which shifts the 4-bit count output of the counter 11 to add a weight thereto, that is to vary the degree of random property, and a depth setting switch 13 which sets the amount of shift applied by the depth selection circuit 12. The depth setting switch 13 is constructed to produce a depth setting signal LC which designates the depth (amount of shift) in five stages of from zero to a maximum when its movable contact 13*f* is thrown along stationary contacts 13*a* through 13*e*.

Figure 4:
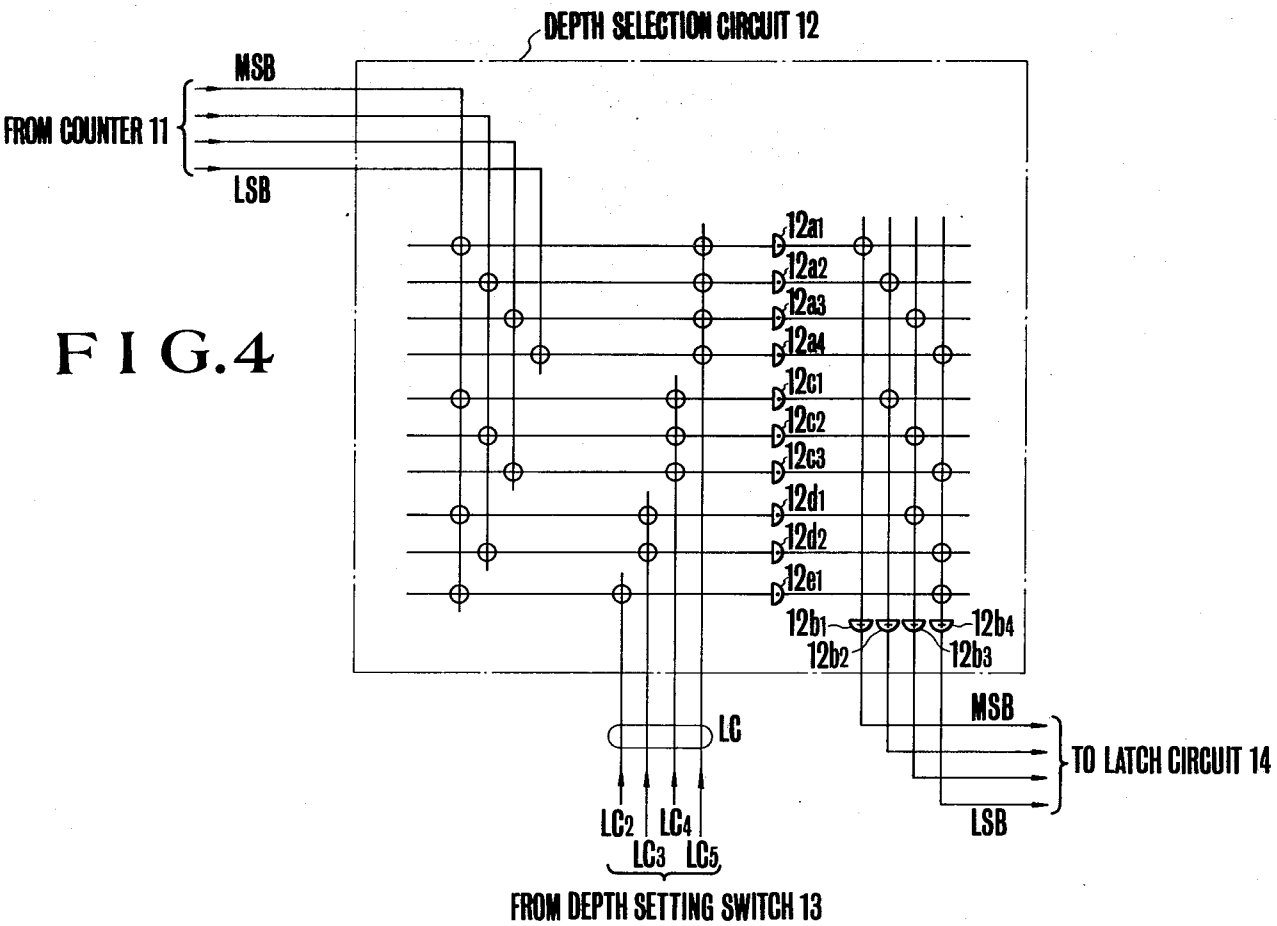
FIG. 4 is a connection diagram showing one example of the depth selection circuit shown in FIG. 1.

There is also provided a latch circuit 14 which latches the output of the depth selection circuit 12 in response to the latch pulse LP supplied from the one-shot circuit at the time of commencing key depression and holds the output until the next latch pulse LD is supplied. The output of the latch circuit 14 is used as a random signal X. The oscillator 10, counter 11, depth selection circuit 12 and latch circuit 14 constitute a random signal generating unit 15. The depth selection circuit 12 is constructed as shown in FIG. 4, for example.

More particularly, the depth selection circuit 12 is connected to receive the depth setting signals LC from the depth setting switch 13. For example, when depth setting signal $LC_5$ is applied AND gate circuits 12a1 through 12a4 are enabled to supply the count output of the counter 11 to supply the count output of the counter 11 to the latch circuit 14 via OR gate circuits 12b1 through 12b4 without any change. Then, when the depth setting signal $LC_4$ is applied, AND gate circuits 12c1 through 12c3 are enabled whereby only the upper three bits of the count output of the counter 11 are selected and then applied to OR gate circuits 12b2 through 12b4 after shifting down the bits by one. When the depth setting signal $LC_3$ is supplied AND gate circuits 12d1 and 12d2 are enabled whereby only the upper two bits of the count output of the counter 11 are selected and then applied to OR gate circuit 12b3 and 12b4 after shifting down the bits by two. Furthermore, when depth setting signal $LC_2$ is supplied, AND gate circuit 12e1 is enabled so that only one upper bit of the count output of the counter 11 is selected and then supplied to OR gate circuit 12b4 after shifting down the bits by three. Since the depth setting signal $LC_1$ is not supplied to the depth selection circuit 12, the output signals of the depth selection circuit 12 are all "0" at this time. Thus, the depth selection circuit 12 described above shifts down the bits of the count output of the counter 11 by one to three bits in accordance with the depth setting signals $LC_5$ through $LC_1$ to form outputs, whereas when the depth setting signal $LC_5$ is applied, the count output of the counter 11 is produced as the output without any change thus providing the deepest state.

Figure 5:
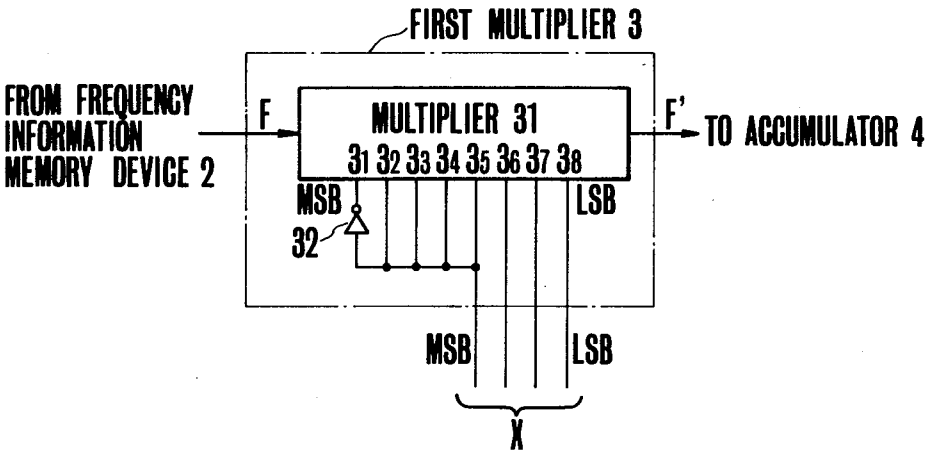
FIG. 5 shows one example of the first multiplier utilized in the circuit shown in FIG. 1.

The four-bit random signal X produced by the random signal generating unit 15 is applied to the first multiplier 3 where it is multiplied with the frequency information F. However, when the 4-bit random signal X is directly multiplied, the modified frequency information F' would greatly differ from the frequency information F so that it would become impossible to produce a pitch corresponding to the depressed key. For this reason, as shown in FIG. 5, the four-bit random signal X supplied to a multiplier 31 of the first multiplier 3 is supplied to the lower 4 bits $3_5$ through $3_8$ of the 8-bit inputs $3_1$ through $3_8$ of the multiplier 3a while the most significant bit of the random signal X is applied to the upper three bits $3_2$, $3_3$ and $3_4$ and to the most significant bit $3_1$ through an inverter $3_2$. The most significant bit $3_1$ of the 8-bit multiplier 3a which is connected to receive the most significant bit of the random signal X is in charge of an integer while the other 7 bits of the multiplier 31 are in charge of fractional digits.

Accordingly, where the random signal X is expressed by a binary code "0111" the 8-bit inputs $3_1$ through $3_8$ of the multiplier 31 is expressed by a code "10000111" (1.0546 in terms of decimal number) whereas when the random signal X is "1000", the 8-bit inputs $3_1$–$3_8$ of the multiplier 3a is "01111000" (0.9375 in decimal). Further when the random signal X is "0000" the 8-bit inputs $3_1$–$3_8$ is "10000000" (just "one" in terms of decimal number). Consequently, the modified frequency information $F^1$ varies slightly about the frequency information F.

The random signal X generated by the random signal generating unit 15 is also applied to a digital-to-analog (D-A) converter 17 where a digital input is converted into a corresponding analogue signal Ax which is synthesized or combined with the output voltage of a variable resistor 18 utilized to set the sustain level for the envelope waveform generator 9 through resistors 19 and 20 and the resulting signal is applied to the terminal 97c of the envelope waveform generator 9 (see FIG. 3). In this manner, the sustain level of the envelope waveform EC generated by the envelope waveform generator 9 is variably controlled by the analogue random signal Ax.

The electronic musical instrument described above operates as follows. When a power switch, not shown, is turned on, the oscillator 10 of the random signal generating unit 15 shown in FIG. 1 operates to produce an oscillation output which is sequentially counted by the 4-bit counter 11 and the instrument is in a free running state. More particularly the oscillator 10 and the counter 11 constitute a free running counter which sends out a digital output. Then, when the movable contact 13f of the depth-setting switch 13 is thrown to the stationary contact 13a, a depth-setting signal $LC_1$ is produced from the stationary contact 13a. As has been pointed above, this depth-setting signal $LC_1$ is not supplied to the depth selection circuit 12. Consequently, the depth selection circuit 12, the detail thereof being shown in FIG. 4, prevents the count output from the counter 11 so that the outputs of the depth selection circuits 12 are all "0".

When a key of the keyboard is depressed under this state, one of the key switches $1_l$ through $1_n$ (FIG. 2) corresponding to the depressed key operates so to send out the output of the key switch having the highest order of preference to the frequency information memory device 2 from the key switch circuit 1 to act as a key data KD. Furthermore the key switch circuit 1 produces a key-on signal KON representing that the key is being depressed (through the OR gate circuit $I_x$ shown in FIG. 2). This key-on signal KON is applied to the one-shot circuit 8 to be converted thereby into a narrow latch pulse LP synchronous with the building up of the key-on signal KON, and the latch pulse LP is supplied to the latch circuit 14 of the random signal generating unit 15. The latch circuit 14 latches the output of the depth selection circuit 12 as the latch pulse LP is applied, and holds the latched output until the next latch pulse is received. At this time, however, since the outputs of the depth selection circuit 12 are all "0" (all bits are "0") as above described, the random signals X latched and produced by the latch pulse 14 are also all "0".

The frequency information memory device 2 is addressed by the key data KD supplied from the key switch circuit 1 so as to read out a frequency information having a value as shown in the following Table 1 and corresponding to the tone pitch (frequency of the depressed key). The read out frequency information F is latched by the latch pulse LP supplied from the one-shot circuit 8, and this condition is held until the next latch pulse is received.

Table 1

| | integer part | | | | | fractional part | | | | | | | | | | |
|---|---|---|---|---|---|---|---|---|---|---|---|---|---|---|---|---|
| | $F_{15}$ | $F_{14}$ | $F_{13}$ | $F_{12}$ | $F_{11}$ | $F_{10}$ | $F_9$ | $F_8$ | $F_7$ | $F_6$ | $F_5$ | $F_4$ | $F_3$ | $F_2$ | $F_1$ | F number |
| $C_2$ | 0 | 0 | 0 | 0 | 0 | 1 | 1 | 0 | 1 | 0 | 1 | 1 | 0 | 0 | 1 | 0.052325 |
| $C_3$ | 0 | 0 | 0 | 0 | 1 | 1 | 0 | 1 | 0 | 1 | 1 | 0 | 0 | 1 | 0 | 0.104650 |
| $C_4$ | 0 | 0 | 0 | 1 | 1 | 0 | 1 | 0 | 1 | 1 | 0 | 0 | 1 | 0 | 1 | 0.209300 |
| $C_5$ | 0 | 0 | 1 | 1 | 0 | 1 | 0 | 1 | 1 | 0 | 0 | 1 | 0 | 1 | 0 | 0.418600 |
| $C_6$ | 0 | 1 | 1 | 0 | 1 | 0 | 1 | 1 | 0 | 0 | 1 | 0 | 1 | 0 | 0 | 0.837200 |
| $D_6$# | 0 | 1 | 1 | 1 | 1 | 1 | 1 | 1 | 0 | 1 | 1 | 1 | 0 | 0 | 0 | 0.995600 |
| $E_6$ | 1 | 0 | 0 | 0 | 0 | 1 | 1 | 1 | 0 | 0 | 0 | 0 | 0 | 0 | 1 | 1.054808 |
| $C_7$ | 1 | 1 | 0 | 1 | 0 | 1 | 1 | 0 | 0 | 1 | 0 | 1 | 0 | 0 | 1 | 1.674400 |

In the first multiplier 3, the frequency information F is multiplied with the random signal generated by the random signal generating unit 15. As above described since all bits of the random signal X are "0" the 8-bit inputs 3, through $3_8$ of the multiplier 31 of the first multiplier 3 become "10000000" (FIG. 5) which corresponds to a decimal number "one". Under this state in which the movable contact 13f of the depth setting switch 13 is engaging the stationary contact **13*a*, the first multiplier 3** multiplies the frequency information F with a decimal number one so that the resulting modified frequency information F′=F.

The modified frequency information F′ is repeatedly accumulated by the accumulator 4 and its accumulated value qF′ is used to address the waveform memory device 5 for sequentially reading out the waveform amplitude values which have been stored in respective addresses.

The key-on signal KON generated by the key switch circuit 1 is also applied to the envelope waveform generator 9 to produce the attack and sustain envelope waveform EC as the key-on signal KON is produced. When the key-on signal KON disappears when the key is released, a decay envelope waveform EC is produced.

As above described, since all the bits of the random signal X generated by the random signal generating unit 15 are "0", the analogue random signal Ax generated by the D-A converter 17 is also zero. Consequently, the sustain level supplied to the terminal **97*c* of the envelope waveform generator 9 is at a constant value set only by the output voltage value of the variable resistor 18 with the result that the envelope waveform generator 9 generates an envelope waveform EC having a sustain level of a value set by the variable resistor 18. This envelope waveform EC is applied to the second multiplier 6 where it is multiplied with the musical tone wave read out from the waveform memory device to be imparted with a volume envelope. The resulting musical tone waveform imparted with the volume envelope is converted into a musical tone by the sound system 7. Thus, so long as the movable contact 13*f* of the depth setting switch 13 of the random signal generating unit 15 is engaging the stationary contact 13*a*** the random signal X is always "0" so that the pitch and volume of the generated musical tone would never be modified by the random signal X thus producing an inherent musical tone which is determined by the musical tone setting conditions set by various operating members on the panel of the musical instrument.

The operation described above is identical to that of the monophonic construction of the electronic musical instrument of the waveform memory read out type disclosed in U.S. Pat. No. 3,882,751 dated May 13, 1975.

When the movable contact **13*f* of the depth setting switch 13 is transferred to the stationary contact 13*d*, for example, the depth setting switch 13 applies a depth setting signal $LC_4$ to the depth selection circuit 12. As shown in FIG. 4, when the depth selection circuit 12 is supplied with the depth setting signal $LC_4$, as shown in FIG. 4, AND gate circuits 12*c*1–12*c*3 select the upper three bits out of the 4-bit output produced by the counter 11 which is now in the free running state, shift down the selected bits by one and then send them via OR gate circuits 12*b*2, 12*b*3 and 12*b*4. This means that the depth selection circuit 12 reduces to ½ the output of the counter which cyclically changes between "0000" and "1111" whereby the output of the depth selection circuit 12 varies in a range of from "0000" to "0111". Under these conditions, when a key is depressed the key switch circuit 1 produces a key data KD and a key-on signal KON corresponding to the depressed key. In response to a key-on signal KON produced by the key switch circuit 1, the one-shot circuit 8 produces a latch pulse LP which is used to hold a frequency information F addressed by the key data KD and read out from the frequency information memory device 2. Further, the latch pulse LP is supplied to the latch circuit 14 to latch and continuously produce the output of the depth selection circuit 12 which is produced at the time when the latch pulse is applied. Consequently, the value of the random signal X produced by the latch circuit 14 varies depending upon the timing of the latch circuit 14, that is the timing of generating the latch pulse in synchronism with the building up of the key-on signal KON which is produced corresponding to the depression of the key. Thus, the value of the random signal produced by the random signal generating unit 15 varies depending upon the timing of depressing the key so that the value of the random signal is different for different keys. The random signal X is applied to the first multiplier 3 where it is multiplied with a frequency information F produced by the frequency information memory device 2. Consequently, the random signal X selected with the timing of depressing the key is multiplied with the frequency information F′ so that the output of the accumulator 4 which sequentially accumulates the modified frequency information F′ varies more or less in accordance with the random signal X. Accordingly, the speed of reading out the waveform memory device 5 varies corresponding to the variation in the random signal X with the result that the tone pitches of the generated musical tones become randomly different more or less from one depressed key to the other. The random signal X generated by the random signal generating unit 15 is converted into an analogue random signal Ax by the D-A converter 17 and this analogue random signal Ax is combined with the output of the variable resistor 18 adapted to adjust the sustain level, and the resultant signal is applied to terminal 97*c* for adjusting the sustain level. As a consequence, the envelope waveform generator 9 shown in FIG. 3 generates an envelope waveform EC having a sustain level corresponding to the analogue random signal Ax having different content for different depressed keys and the generated envelope waveform EC is applied to the second multiplier 6 which multiplies it with a musical tone signal supplied from the waveform memory device 5 thereby imparting to the musical tone such amplitude envelope as attack, sustain and decay. Since the sustain level of the envelope waveform EC supplied from the envelope waveform generator 9** varies corresponding to the analogue random signal Ax, the sustain level of the volume envelope of the generated musical tone varies randomly for different depressed keys.

As shown by dotted lines, if desired, the musical tone signal generated by the second multiplier 6 may be supplied to the sound system 7 through a voltage controlled type filter 21 (VCF) and by controlling the cut off frequency of the VCF by the analogue random signal Ax produced by the D-A converter 17 the tone color of the generated musical tone can be randomly varied for different depressed keys similar to the pitch and volume of the tone.

In the foregoing description, a case wherein the movable contact 13*f* of the depth setting switch 13 is thrown to the stationary contact 13*a* was described, but similar operation takes place in the case wherein the movable contact is thrown to the other stationary contact 13*b*, 13*c* or 13*e*. In these cases random signals X respectively corresponding to $\frac{1}{8}$, $\frac{1}{4}$ and 1/1 of the output of the counter 11 in the free running state are produced for randomly varying the pitch, color and volume of the generated musical tone in the ranges specified just above.

The random control of the musical elements, that is pitch, color and volume of a monophonic electronic musical instrument of the waveform memory read out type has been described hereinabove wherein each time a key is depressed the musical elements (pitch, color and volume) of the generated musical tone are randomly varied in a range set by a depth setting switch 13 thereby enriching the quality of the musical tone generated.

Figure 6:
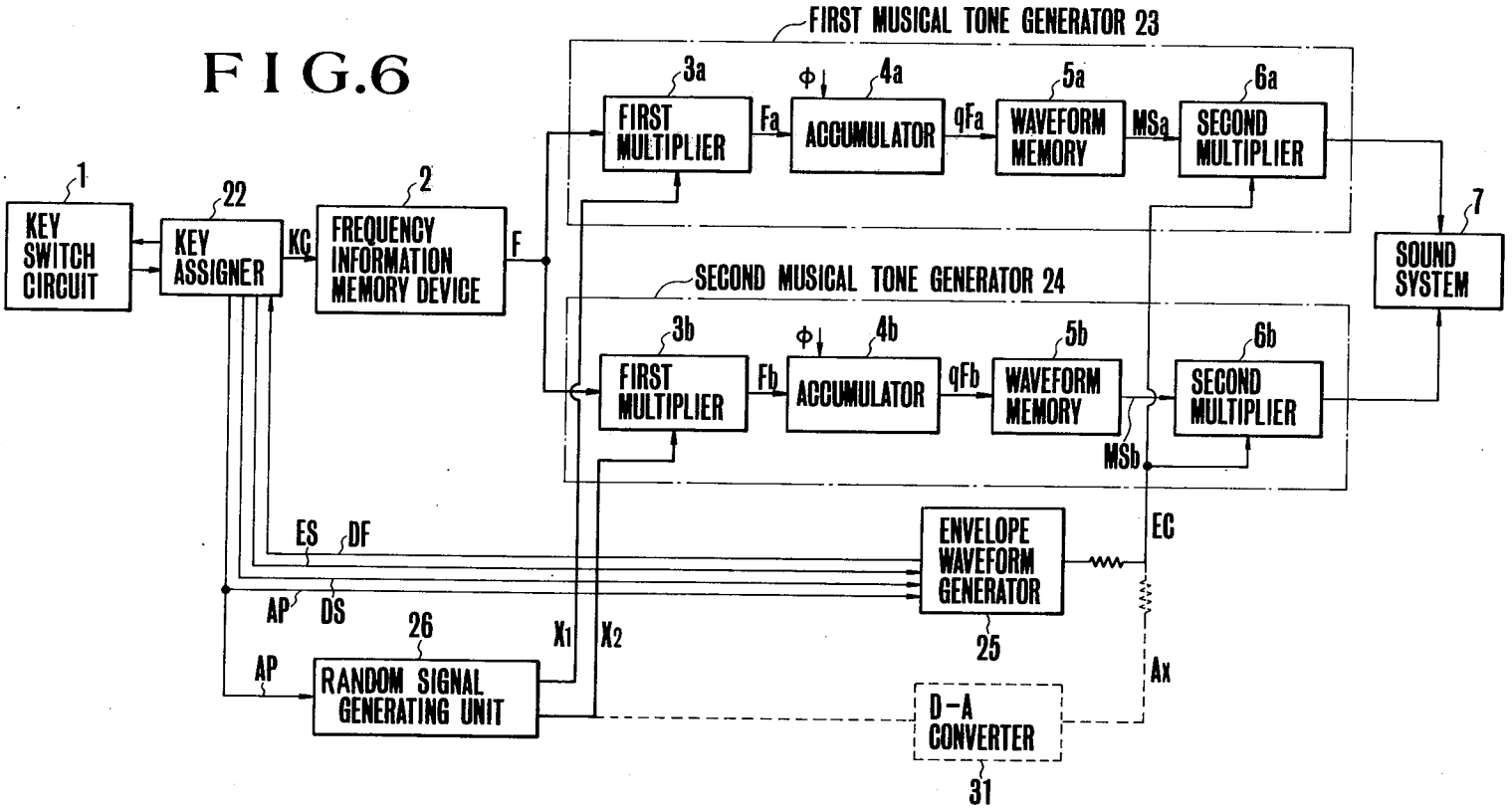
FIG. 6 is a block diagram showing a modified embodiment of the electronic musical instrument embodying the invention.

FIG. 6 shows another embodiment of this invention wherein it is applied to a polyphonic musical instrument comprising a plurality of tone generating channels corresponding to the number of tones simultaneously generated. Each channel includes two series of musical tone generating circuits thereby producing musical tones having different random musical elements between the tone generating channels and between the musical tone generating circuits. In FIG. 6 elements corresponding to those shown in FIG. 1 are designated by the same reference numerals. In this modification, a key assigner 22 is provided for detecting the on or off operation of the key switches $1_1$ through $1_n$ (see FIG. 2) of the key switch circuit 1 by sequentially scanning with a clock pulse $\phi$ having a frequency supplied from a clock pulse generator, not shown, so as to assign an information that identifies a depressed key to either one of the plurality of keys corresponding to the number (for example 12) of tones which are generated simultaneously. The key assignor stores a key code KC that represent a depressed key at a memory position corresponding to a channel and sequentially produces on the time division basis the key codes KC stored in respective channels. Thus, when a plurality of keys of the keyboard are simultaneously depressed the depressed keys are assigned to different keys, and at the memory positions corresponding to respective channels are stored key codes KC representing the assigned keys. For example, as shown in the following Table 2, the keys codes that specify respective keys of the keyboard are constituted by a total of 9-bit codes comprising bit codes $K_2$ and $K_1$ which represent the type of the keyboard, three-bit codes $B_3$, $B_2$ and $B_1$ which represent the octave range, and 4 bit codes $N_4$, $N_3$, $N_2$ and $N_1$ which represent the note name in one octave. Where the total number of the channels is 12, it is advantageous to use a shift register having 12 stages each including 9 bits.

Table 2

| key | | $K_2$ | $K_1$ | $B_3$ | $B_2$ | $B_1$ | $N_4$ | $N_5$ | $N_2$ | $N_1$ |
|---|---|---|---|---|---|---|---|---|---|---|
| | | | | | | key code | | | | |
| keyboard | upper | 0 | 1 | | | | | | | |
| | lower | 1 | 0 | | | | | | | |
| | pedal | 1 | 1 | | | | | | | |
| | first | | | 0 | 0 | 0 | | | | |
| | second | | | 0 | 0 | 1 | | | | |
| octave | third | | | 0 | 1 | 0 | | | | |
| range | fourth | | | 0 | 1 | 1 | | | | |
| | fifth | | | 1 | 0 | 0 | | | | |
| | sixth | | | 1 | 0 | 1 | | | | |
| | C# | | | | | 0 | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| note | F# | | | | | | 0 | 1 | 1 | 0 |
| name | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

Accordingly the key code KC (that is the key code stored in the shift register) which is designated by the key assigner 22 to generate a tone is sequentially produced on the time division basis in coincidence with the assigned channel time. Further the key assigner 22 generates an envelope start signal ES which represents that the channel assigned with a depressed key on the time division bases and in synchronism with each channel time. In addition, the key assigner 22 produces on the time division basis and in synchronism with each channel time a decay start signal DS representing that a key assigned to a channel to produce a tone has been released whereby the generated tone is attentuating. One attack pulse AP having a pulse width equal to one time slot is produced in synchronism with the build up time of the envelope start signal ES. These signals ES, DS and AP are utilized by an envelope waveform generator 25 to be described later for controlling the amplitude envelope of the musical tone (tone generation control). The key assigner 22 is connected to the envelope waveform generator 25 to receive therefrom a decay termination signal DF representing that the tone generation has been finished (the decay has been finished). In response to the decay termination signal DF, the key assigner 22 clears various memories regarding a given channel thus assuming a waiting state for a key depressed next time. The modification shown in FIG. 6 further comprises a first musical tone signal generating circuit 23 including a first multiplier 3*a*, an accumulator 4*a*, a waveform memory device 5*a*, and a second multiplier 6*a*; and a second musical tone signal generating circuit 24 including a first multiplier 3*b*, an accumulator 4b, a waveform memory device 5b and a second multiplier 6b. Signals generated by these musical tone generating circuits 23 and then produced as a performance tone from the sound system 7. A random signal generating unit 26 is provided for generating two types of random signals $X_1$ and $X_2$ having values determined by the timing of the attack pulse generated by the key assignor 22. The generated random signals $X_1$ and $X_2$ are applied to first multipliers 3a and 3b respectively.

Having completed the description of the general arrangement of various component elements, each of them will be described in detail in the following.

Since the key assigner 22 is disclosed in detail in the applicants copending U.S. Patent application Ser. No. 714,084 filed on Aug. 13, 1976 under a title of "Key Switch Detection and Processing Apparatus", the description thereof will not be made herein. The key coder 101 and the channel processor 102 shown in FIG. 1 of that patent application respectively correspond to the key assigner 22 of the instant application and signals D, A, and DF produced by delaying signal S shown in FIG. 10 of that application showing the detail of the channel processor 102 respectively correspond to attack pulse AP, decay start signal DS, envelope start signal ES and decay finish signal DF.

The envelope waveform generator 25 is described in detail in the applicants copending U.S. Patent application Ser. No. 837,599 dated Sept. 28, 1977 under the title of "Envelope Generator" so that its detail will not be described herein.

Figure 7:
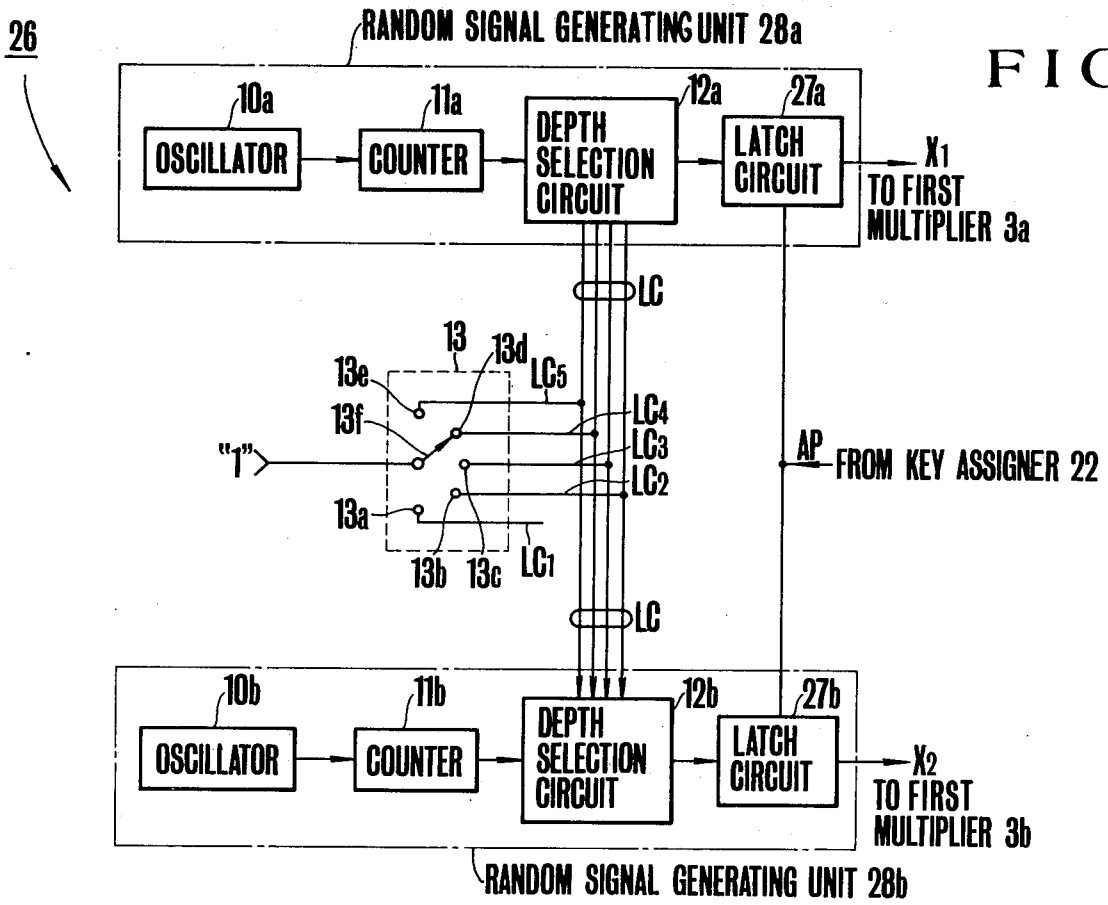
FIG. 7 is a connection diagram showing the detail of the random signal generator shown in FIG. 6.

FIG. 7 shows one example of the random signal generating units 28a and 28b in which the latch circuit 14 of the random signal generating unit 15 shown in FIG. 1 is divided into latch circuits 27a and 27b having a time division construction (12 channels).

Figure 8:
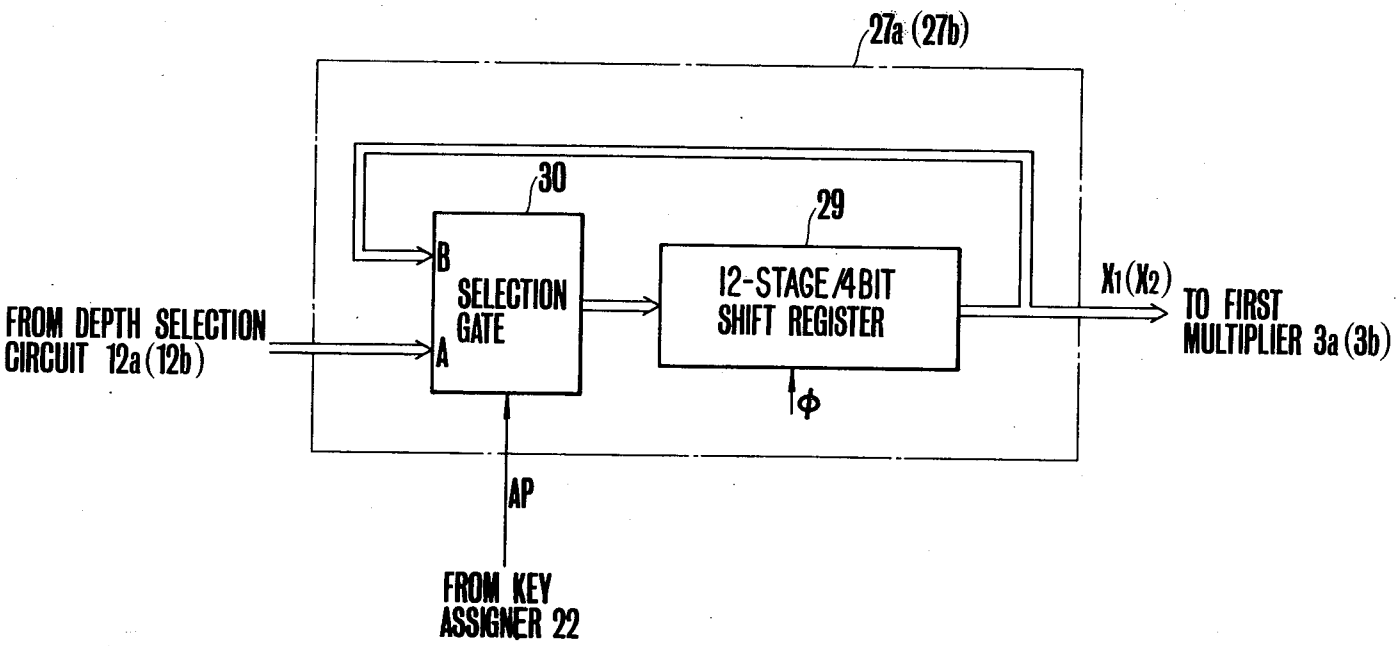
FIG. 8 is a block diagram showing the detail of the latch circuit shown in FIG. 7.

As shown in FIG. 8, each of the latch circuits 27a and 27b having a time division construction is constituted by a 12 stage 4-bit shift register 29 (the maximum number of the generated tones) which is shift controlled by the clock pulse $\phi$ synchronized with respective channel times of the key assigner, and a selection gate circuit 30. When supplied with an attack pulse $AP_1$ the selection gate circuit 30 selects the output of the depth selection circuit 12a or 12b supplied to the first input terminal A and applies the output to the shift register 29. Normally, the output of the last stage of the shift register 29 is applied to the second input B of the selection gate circuit 30 for applying the output to the input of the shift register 29. Consequently, the content of the shift register 29 is sequentially shifted toward its input side whereby the output of the depth selection circuit 12a or 12b at the time of generating the attack pulse AP is written in a stage of the shift register 29 corresponding to a given channel time of the shift register 29 and the written pulse is held in the channel until the next attack pulse AP is generated. Accordingly, the latch circuit 27a or 27b generates, on the time division basis and in synchronism of each channel time, a random signal $X_1$ or $X_2$ which is obtained by latching the count of the counter 11a or 11b produced by the depth selection circuit 12a or 12b under the control of the attack pulse AP. The depth selection circuits 12a and 12b of the first and second random signal generating units 28a and 28b constructed as above described control the depth (shift quantity) of the output of the counter 11a or 11b in accordance with the depth setting signal LC ($LC_1$-$LC_5$) produced by the depth setting switch 13 in the same manner as in the first embodiment shown in FIG. 1.

The modification shown in FIG. 7 operates as follows. More particularly, the oscillators 10a and 10b shown in FIG. 7 oscillate independently, and the counters 11a and 11b adapted to count the number of outputs of the oscillators 10a and 10b are in asynchronous free running states. Under these conditions, when a key of the keyboard is depressed, a key switch corresponding to the depressed key is operated and the key assigner 22 detects the operated key switch of the key switch circuit 1 to assign and store a key code KC (see Table 2) representing the depressed key to either one of the channels corresponding to the number of tones which are generated simultaneously (in this case 12 tones).

The key code KC stored in each channel of the key assigner 22 is sequentially produced on the time division basis for addressing the frequency information memory device 12 thereby reading out the frequency information as shown in Table 1.

The key assigner 22 produces an attack pulse AP having a width equal to one channel time and synchronous with the building up of the envelope start signal ES, and the tones are to be generated by channels to which depressed keys are assigned. The attack pulse AP is applied to the selection gate circuits 30 (FIG. 8) of the latch selection circuits 27a and 27b of the random signal generator 26. The selection gate circuit 30 supplies to the shift register 29 the outputs of the depth selection circuits 12a and 12b which are supplied to the first input terminal A only when the attack pulse AP is supplied. Consequently, the latch circuit 27a and 27b of the time division construction operate to sequentially store the outputs of the depth selection circuits 12a and 12b which are produced when the attack pulse is applied to memory positions corresponding to the channel time at which the attack pulse AP is generated and the outputs thus stored are sequentially produced on the time division basis to act as the random signals $X_1$ and $X_2$, respectively. The latch circuits 27a and 27b of the random signal generating units 28a and 28b perform their latching operations under the control of the same attack pulse whereas the counters 11a and 11b are in the asynchronous free running states in which they count the number of outputs of the oscillators 10a and 10b respectively so that the outputs of these counters 11a and 11b are quite different. Consequently, even though the latch circuits 27a and 27b perform their latching operations under the control of the same attack pulse AP the values latched by these two latch circuits are quite different with the result that the random signals $X_1$ and $X_2$ produced by the random signal generating units 28a and 28b would have random values which are determined by the timing of depressing the keys and the counts of the counters 11a and 11b and these random signals are applied to the first multiplier 3a of the first musical tone signal generating circuit 23 and to the first multiplier 3b of the second musical tone signal generating circuit 24 respectively. The first multiplier 3a functions to multiply the frequency information F generated by the frequency information memory device 2 with the random signal $X_1$ generated by the random signal generator 26 so as to produce a modulated frequency information Fa more or less phase shifted from the frequency information F. The modified frequency information Fa is sequentially accumulated by the accumulator 4a with the timing of the clock pulse $\phi$, the rate of increase in the accumulated value qFa increasing or decreasing corresponding to the random signal $X_1$.

As a consequence, the musical tone signal MSa addressed by the accumulated value and produced by the waveform memory device 5a has a pitch shifted from the standard tone pitch corresponding to the depressed key by an amount corresponding to the random signal $X_1$.

On the other hand, the envelope waveform generator 25 starts its operation in response to the envelope start signal ES and the attack pulse AP which are produced by the key assigner 22 to produce attack and sustain envelope waveform EC having preset attack and sustain levels. Further, the envelope waveform generator 25 produces a decay envelope waveform EC having a decay level set by the decay start signal DS. The musical tone signal MSa read out from the waveform memory device 5a is multiplied by the second multiplier 6a with the envelope waveform EC generated by the envelope waveform generator 25 so that it is imparted with an amplitude envelope. The first multiplier 3b of the second musical tone signal generator 24 multipliers the frequency information with the random signal $X_2$ to form a modified frequency information Fb somewhat shifted from the modified frequency information Fa. In the same manner as the first musical tone signal generating circuit 23 described above the modified frequency informations F*b* are sequentially accumulated by the accumulater 4b, the rate of increase of its accumulated value qFb increasing or decreasing by an amount corresponding to the random signal $X_2$. As a consequence, the musical tone signal MSb addressed by and produced by the waveform memory device 5b has a pitch shifted from a pitch corresponding to the depressed key whereby the second multiplier 6b applies an amplitude envelope corresponding to the envelope waveform EC generated by the envelope waveform generator 25 in a manner as above described. Consequently, the first musical tone signal generating circuit 23 produces a musical tone signal having a pitch modified and controlled by the random signal $X_1$, whereas the second musical tone signal generating circuit 24 produces a musical tone signal modified and controlled by the random signal $X_2$. These two musical tone signals are mixed together by the sound system 7 and then converted into a performance tone. In this manner, the pitches of the musical tone signals generated by the first and second musical tone signal generating circuits 23 and 24 by two random signals $X_1$ and $X_2$ which vary independently are modified and controlled independently and randomly.

The operations described above are performed for each channel on the time division basis but since the timings of generating the attack pulses AP are different for differnt channels the random signals $X_1$ and $X_2$ of each channel have different contents. Consequently, the performance tone produced by the sound system 7 has a rich sound property.

Since the relationship between the depth setting switch 13 and the depth selection circuit 12a and 12b is similar to that of the random signal generating unit 15 shown in FIG. 1 its description is omitted.

Like the embodiment shown in FIG. 1, in the embodiment shown in FIG. 6, if desired either one of the random signals $X_1$ and $X_2$ may be converted into an analogue random signal Ax by means of a D-A converter 31 and by combining the analogue random signal Ax with the envelope waveform signal produced by the envelope waveform generator 25 and then supplying the resultant signal to the first and second multipliers 6a and 6b it is possible to randomly vary the amplitude envelope applied to the generated musical tone.

Although in the embodiment shown in FIG. 7, one depth setting switch 13 was provided in common for the first and second random signal generating units 28a and 28b it should be understood that independent depth setting switches may be provided for respective random signal generating units 28a and 28b for producing different depth setting signals.

Figure 9:
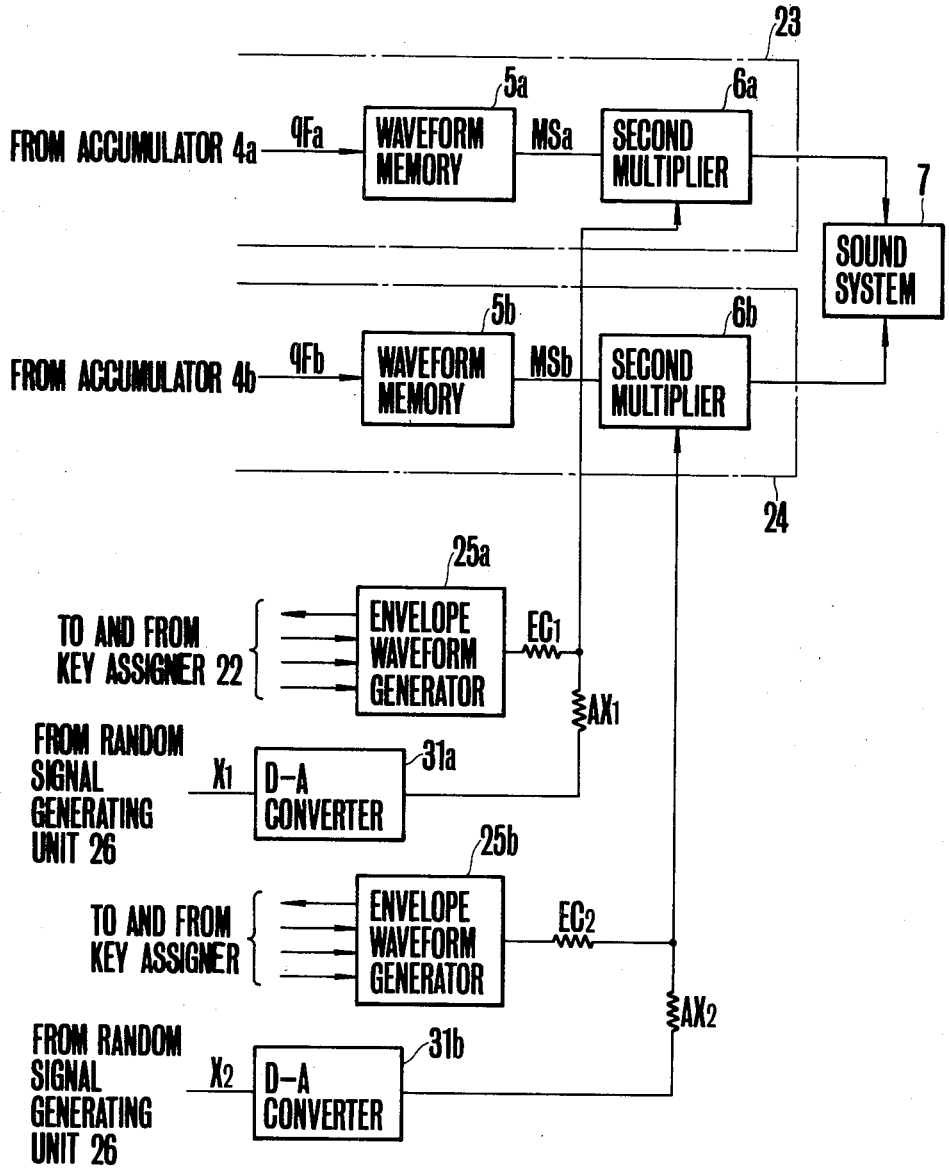
FIG. 9 is a block diagram showing still further embodiment of the electronic musical instrument of this invention.

FIG. 9 shows a modification of the circuit shown in FIG. 6. Thus, in FIG. 9, two independent envelope waveform generators 25a and 25b (corresponding to the envelope waveform generator 25 shown in FIG. 6) are provided respectively for the second multipliers 6a and 6b and the analogue signals $X_1$ and $X_2$ are converted into analogue random signals Ax1 and Ax2 respectively through D-A converters 31a and 31b. The envelope waveforms $EC_1$ and $EC_2$ generated by the envelope waveform generators 25a and 25b are combined with analogue random signals Ax1 and Ax2 respectively and the resulting combined signals are respectively applied to the second multipliers 6a and 6b thereby randomly varying the volume of the musical tone signals generated by the first and second musical tone signal generating circuits 23 and 24 respectively. According to this modification, the ratio of admixing the two musical tone signals in the sound system can be randomly varied so that the color of the resulting musical tone can be varied randomly.

Figure 10:
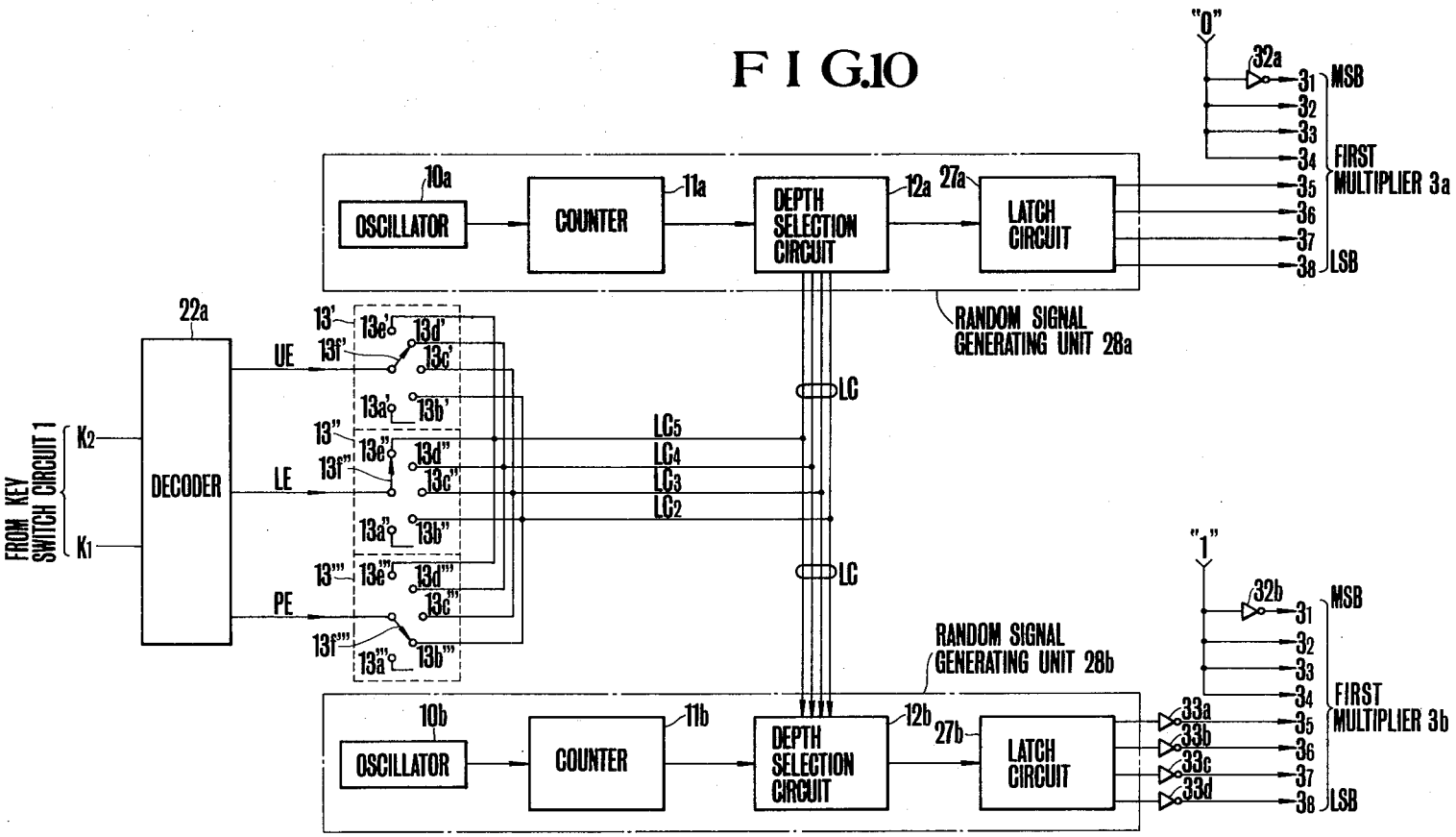
FIG. 10 is a block diagram showing a modification of the random signal generator shown in FIG. 7.

FIG. 10 shows still further modification of the random signal generator 26 in which circuit elements corresponding to those shown in FIG. 7 are designated by the same reference characters. The circuit shown in FIG. 10 is different from that shown in FIG. 7 in that the depth setting switch 13 is made up of three depth setting switches 13', 13'' and 13''' in charge of upper, lower and pedal keyboards respectively and that an upper keyboard signal UE, a lower keyboard signal LE and a pedal keyboard signal PE are applied to respective stationary contacts 13f', 13f'' and 13f''' of the switches 13', 13'' and 13'''. These keyboard signals UE, LE and PE can be readily produced by decoding the upper two bits $K_1$ and $K_2$ of the key code KC shown in Table 2 and produced by decoder 22a when a key is depressed. The stationary contacts 13a'-13e', 13a''-13e'' and 13a'''-13e''' of the switches 13', 13'' and 13''' respectively are commonly connected and their output signals are supplied to the depth selection circuits 12a and 12b to act as the depth setting signals LC ($LC_1$ through $LC_5$). The 4-bit output of the latch circuit 27a is supplied to the lower 4-bit inputs $3_5$ through $3_8$ of the first multiplier 3a having 8-bit inputs, signal "1" is normally supplied to the most significant bit $3_1$ of the first multiplier 3a through inverter 32a and signal "0" is normally supplied to the upper second to fourth bits $3_2$, $3_3$ and $3_4$ of the first multiplier so as to modify and control the first musical tone signal generating circuit 23 in the positive direction (increasing direction). Further, the 4-bit output of the latch circuit 27b is applied to the lower 4-bit inputs $3_5$–$3_8$ of the first multiplier 3b via inverters 33a through 33d, signal "0" is normally applied to the most significant bit $3_1$ of the first multiplier 3b and signal "1" is normally applied to the upper second to fourth bits $3_2$, $3_3$ and $3_4$ so as to modify and control the tone level of the second musical tone signal generating circuit 24 in the negative direction (decreasing direction).

While the movable contacts 13f'-13f'' of the depth setting switches 13'-13''' are maintained in the positions shown in FIG. 10, when any one of the keys of the keyboard is depressed, one of the upper, lower and pedal keyboard signals UE, LE and PE is generated depending upon the type of the keyboard including the depressed key. For example, when the depressed key is included in the upper keyboard, an upper keyboard signal UE is supplied to the depth setting switch 13' alone whereby a depth setting signal $LC_4$ set by the depth setting switch 13' is supplied to the depth selection circuits 12*a* and 12*b* to select the depth quantity (shift quantity). On the other hand, where the depressed key is included in the lower keyboard, the lower keyboard signal LE is supplied only to the depth setting switch 13'', whereas when the depressed key is included in the pedal keyboard the pedal keyboard signal PE is supplied only to the depth setting switch 13'''.

In the random signal generating unit 27 constructed as above described, the depth setting switches 13', 13'' and 13''' are in charge of the depth setting switches of the upper, lower and pedal keyboards respectively so that a depth setting signal LC set by the depth setting switch corresponding to the type of keyboard containing the depressed key is produced which independently set the depth quantity (shift quantity) in the upper, lower and the pedal keyboards respectively. The upper 4-bit inputs $3_1$ through $3_4$ of the first multiplier 3a of the first musical tone signal generating circuit 23 is made always "1000" so that the 8-bit random input signal of the first multiplier 3*a* changes between "10000000" and "10001111" whereby the frequency information is modified and controlled in the increasing direction. Furthermore, since the upper four-bit inputs $3_1$-$3_4$ of the first multiplier 3*b* of the second musical tone signal generating circuit 24 are always "0111" and since the 4-bit output signals of the latch circuit 27b are inverted by inverters 32*a* through 32*d* and then applied to the lower 4-bit inputs $3_5$ through $3_8$ the 8-bit input signal of the first multiplier changes between "01111111" and "01110000" whereby the frequency information F is modified and controlled in the decreasing direction. Thus the first and second musical tone signal generating circuits 23 and 24 produce musical tone signals whose pitches vary in the opposite directions with respect to the random signals $X_1$ and $X_2$. Although inverters 32*a* through 32*d* may be omitted since the musical tone signal generating circuits 23 and 24 control the tone pitch in the opposite directions, where these inverters are not used, the outputs of the latch circuits 27*a* and 27*b* would become larger so that the amount of modification for the basic pitch would deviate greatly. In this modification since the depth setting switches 13', 13'' and 13''' are provided for the keyboards of the different type the widths of the variations of the random signals $X_1$ and $X_2$ generates by the random signal generating units 28*a* and 28*b* can be independently set for different types of the keyboards. Accordingly, the first and second musical signal generating circuits 23 and 24 produce musical tone signals having different characteristics for the keyboards of the different type.

In the foregoing embodiment, although the output signals of the depth setting switches 13', 13'' and 13''' are applied in common to the depth selection circuits 12*a* and 12*b* independent depth setting switches may be provided for different depth selection circuits 12a and 12b for providing different amounts of setting.

In the embodiments of this invention shown in FIGS. 1 and 6, for the purpose of modifying and controlling the generated musical tone so as to impart randomness thereto, the frequency information from the frequency information memory device 2 is multiplied with random signal X, $X_1$ or $X_2$ by the first multiplier 3, 3*a* or 3*b*. However, other operational circuit as an adder or subtracter can be substituted for the multiplier. Furthermore, although in the embodiments shown in FIGS. 1, 6 and 9 the depth selection circuits 12, 12*a* and 12*b* are installed on the input side of the latch circuits 14, 27*a* and 27*b*, it will be clear that it is also possible to install the depth selection circuit on the output side of the latch circuit.

As above described according to this invention, the musical elements such as the pitch, color and the volume of the musical tone generated by an electronic musical instrument are modified and controlled by a random signal whose content varies according to the timing of the key operation thereby enriching the content of the performance tone by imparting a randomness to the musical elements. As the random signal generating unit for generating the random signal is digitalized by constructing it with a counter which counts the number of reference signals and a latch circuit which latches the output of the counter when a pulse signal representing depression of a key is applied, in an electronic musical instrument wherein musical tones are formed with a digital system it is possible to readily impart randomness to various musical tone elements of the musical tone generated by the electronic musical instrument and to fabricate the entire circuit thereof with integrated circuits.

It should be understood that the invention is not limited to the specific embodiments described above and that many changes and modifications will be obvious to one skilled in the art.

What is claimed is:

1. An electronic musical instrument comprising:

a key switch circuit means including a plurality of switches corresponding to the respective keys of an input keyboard and adapted to generate in response to the depression of each key a note designating signal and a timing signal corresponding thereto;

a random signal generator including, a self-running counter for producing a multi-bit digital signal, a latch circuit responsive to said timing signal and operative to latch the output of said self-running counter to provide a random signal; and a musical tone signal generating means responsive to said note designating signal and said timing signal and operative to generate a musical tone signal having a pitch corresponding to a particular key depressed, said tone signal generating means including means responsive to said random signal and operative to modify at least one musical characteristic of said musical tone signal.

2. An electronic musical instrument as recited in claim 1 wherein said musical tone signal generating means includes a frequency information memory device adapted to store frequency information corresponding to each key of said keyboard, said memory device being addressable by said note designating signal and operative to read out a corresponding frequency signal, circuit means for multiplying said frequency signal by said random signal to form a modified frequency signal, accumulator means for accumulating said modified frequency signal so that the accumulated signal can be repeatedly read out, and a waveform memory device including a plurality of addresses for storing amplitude values sampled at successive points in one period of a desired musical tone wave, and means responsive to the output of said accumulator means for sequentially reading out said amplitude values to develop said musical tone signal.

3. An electronic musical instrument as recited in claim 2 wherein said tone signal generating means further includes a digital-to-analog converter for converting said random signal into an analog signal, an envelope waveform generator responsive to said analog signal and operative to develop an envelope signal, and means responsive to said envelope signal and operative to modify the amplitude of said musical tone signal in accordance therewith.

4. An electronic musical instrument as recited in claims 1 or 2 wherein said signal generating means further includes a digital-to-analog converter for converting said random signal into an analog signal and a voltage-controlled variable filter means responsive to said analog signal and operative to modify the timbre of said musical tone signal.

5. An electronic musical instrument as recited in claim 3 wherein said signal generating means further includes a voltage-controlled variable filter means responsive to said analog signal and operative to modify the timbre of said musical tone signal.

6. An electronic musical instrument as recited in claims 1, 2 or 3 wherein said signal generating means further includes means for converting said digital signal into a different digital signal in accordance with a predetermined factor for the purpose of varying the degree of randomness of said random signal.

7. An electronic musical instrument as recited in claim 6 which further includes means for selectively setting said factor to one of several different values.

8. An electronic musical instrument as recited in claim 1 wherein said random signal generator further includes means for providing a second random signal, and further comprising:

a key switch circuit means including a plurality of switches corresponding to the respective keys of an input keyboard and adapted to generate in response to the depression of each key a note designating signal and a timing signal corresponding thereto; and a second musical tone signal generating means responsive to said note designating signal and said timing signal and operative to generate a second musical tone signal having a pitch corresponding to the particular key depressed, said second tone signal generating means including means responsive to said second random signal and operative to modify at least one musical characteristic of said second musical tone signal.

9. An electronic musical instrument as recited in claim 8 and further comprising a frequency information memory device adapted to store frequency information corresponding to each key of said keyboard, said memory device being addressable by said note designating signal and operative to read out a corresponding frequency signal; and wherein each said musical tone generating means includes circuit means for multiplying said frequency signal by said one of said random signals to form a modified frequency signal, accumulator means for accumulating the corresponding modified frequency signal so that such accumulated signal can be repeatedly read out, and a waveform memory device including a plurality of addresses for storing amplitude values sampled at successive points in one period of a desired musical tone wave, and means responsive to the output of the accumulator means for sequentially reading out the stored amplitude values to develop a corresponding musical tone signal.

10. An electronic musical instrument as recited in claim 9 and further comprising:

digital-to-analog converter means for converting said random signals into corresponding analog signals; and envelope waveform generating means for developing envelope signals, and means responsive to the analog signals and the envelope signals and operative to modify the amplitude of said musical tone signals in accordance therewith.

11. An electronic musical instrument as recited in claims 8 or 9 and further comprising:

digital-to-analog converter means for converting the corresponding random signal into a corresponding analog signal; and a voltage-controlled variable filter means responsive to the corresponding analog signal and operative to modify the timbre of the corresponding musical tone signal.

12. An electronic musical instrument as recited in claim 10 wherein each said signal generating means further includes a voltage-controlled variable filter means responsive to the corresponding analog signal and operative to modify the timbre of the corresponding musical tone signal.

13. An electronic musical instrument as recited in claims 8, 9 or 10 wherein each said signal generating means further includes means for converting the corresponding digital signal into a different digital signal in accordance with a predetermined factor for the purpose of varying the degree of randomness of the corresponding random signal.

14. An electronic musical instrument as recited in claim 13 which further includes means for selectively setting each said factor to one of several different values.

15. An electronic musical instrument as recited in claims 1, 2, 3, 5, 8, 9, 10 or 12 and further comprising means for converting the generated musical tone signals into audible sounds.

* * * * *